United States Patent [19]

Fickert

[11] Patent Number: 4,485,925

[45] Date of Patent: Dec. 4, 1984

[54] RECEPTACLE FOR ADMINISTERING INSULIN

[76] Inventor: Richard A. Fickert, 74 Vaughn St., Lakeville, Mass. 02346

[21] Appl. No.: 241,475

[22] Filed: Mar. 9, 1981

[51] Int. Cl.[3] ..... B65D 85/42

[52] U.S. Cl. ..... 206/534; 206/533; 206/538; 206/438; 221/5

[58] Field of Search ..... 206/533, 534, 538, 438, 206/570; 116/308; 220/21; 221/2, 5

[56] References Cited

U.S. PATENT DOCUMENTS

| | | | |
|---|---|---|---|
| 3,285,459 | 1/1966 | Gahm | 206/534 |
| 3,326,360 | 6/1967 | Lyon | 206/533 |
| 3,365,099 | 1/1968 | McTaggart | 206/535 |
| 3,904,075 | 9/1975 | Richardson et al. | 206/534 X |
| 3,921,806 | 11/1975 | Wawracz | 206/534 |
| 3,958,690 | 5/1976 | Gee | 206/232 |
| 4,083,452 | 4/1978 | Rossmo | 206/533 |
| 4,164,301 | 8/1979 | Thayer | 206/534 X |
| 4,250,998 | 2/1981 | Taylor | 206/570 |

FOREIGN PATENT DOCUMENTS

| | | | |
|---|---|---|---|
| 269942 | 8/1964 | Australia | 206/534 |

*Primary Examiner*—William T. Dixson, Jr.
*Assistant Examiner*—Brenda J. Ehrhardt
*Attorney, Agent, or Firm*—Robert T. Gammons

[57] ABSTRACT

A receptacle for dispensing insulin in prescribed dosages and a method of administering daily dosages of insulin.

4 Claims, 6 Drawing Figures

RECEPTACLE FOR ADMINISTERING INSULIN

BACKGROUND OF THE INVENTION

Diabetics, depending upon their condition, must receive dosages at prescribed intervals, for example, once or twice a day. It is important not to miss a dosage nor to take more than one dosage in a given period. This can usually happen because the insulin is supplied in vials in a quantity representing a plurality of dosages and if the diabetic forgets to take a dosage at a prescribed time and then later on wonders whether he did or did not take the dosage, it is virtually impossible for him to verify whether he did or did not take the prescribed dosage because the volume of the single dosage does not reduce the total volume in the vial sufficiently to be detectable. Hence, the diabetic may fail to take the required dosage or he may take an additional dosage which is just as serious as not taking a dosage. There are dispensers available for medical tablets, pills and the like provided with pockets representing the days of the week for receiving a corresponding number of tablets or pills designed for the purpose of making sure that a patient takes only one tablet or pill per day. However, such dispensers are not designed for dispensing insulin since insulin is not packaged in single dosages, but, on the contrary, is packaged in volume representing a plurality of dosages, for example, a sufficient volume to provide one or two dosages each day for an entire week or more. Dispensers for dispensing tablets or pills such as referred to are shown in U.S. Pat. Nos. 3,326,360; 3,365,099; 3,904,075; 3,921,806; 3,958,690; 4,083,452; and 4,164,301. It is the purpose of this invention to provide a dispenser for insulin and a method of dispensing insulin which will enable the diabetic to keep close account of his consumption of insulin from day-to-day whether required to take a single dosage or two dosages a day and to enable him to do so even though his memory may not be the best or his eyesight may be partially or totally impaired by his condition. The structures shown in the named patents are not suitable for this purpose.

SUMMARY OF INVENTION

As herein illustrated, the invention comprises the combination of a receptacle for insulin and a vial of insulin containing a plurality of dosages of insulin, wherein the receptacle comprises circularly-arranged pockets corresponding in number to the days of the week, said pockets being dimensioned to receive the vial of insulin, a vial of insulin positioned in one of the pockets representing a specific day of the week, said receptacle being transferable from the pocket it initially occupies to the next succeeding pocket in the order of the arrangement of the pockets after the dosage has been taken so that the diabetic by sight or feel can determine that he has taken the dosage for that day and that he is not to take anoteer dosage until the next day. The aforesaid structure is designed specifically for diabetics who are required to take a single dosage each day. For diabetics required to take two dosages, the structure embodies in addition to the circularly-arranged pockets representing the days of the week, a centrally-located pocket and in the combination the vial is transferred from a pocket representing a particular day of the week after taking the desired dosage to the centrally-located pocket where it remains until the second dosage that day is required, whereupon it is transferred from the centrally-located pocket back to the succeeding circularly-arranged pocket for the next day. The structure thus comprises a receptacle containing either a series of circularly-arranged pockets corresponding to the number of the days of the week or a receptacle containing a series of circularly-arranged pockets corresponding to the days of the week with a centrally-located pocket. A cover is desirably hinged to the structure adjacent the pocket representing a specific day so that, by touch or sight, this pocket may be identified and the succeeding pockets counted therefrom so that if this pocket represents Sunday, the succeeding pockets represent the remaining days of the week. The cover, desirably, may also have raised indicia located thereon above the pocket and these may be letters corresponding to the first letters of the days of the week.

The invention will now be described in greater detail with reference to the accompanying drawings, wherein.

Figure 6:
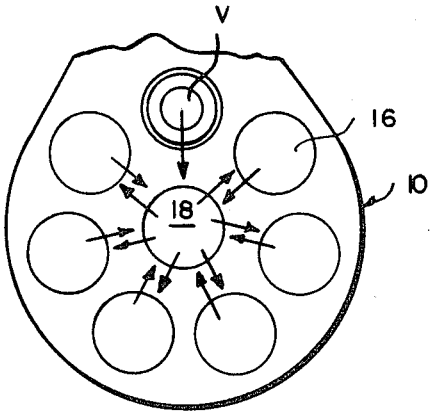
Figure 5:
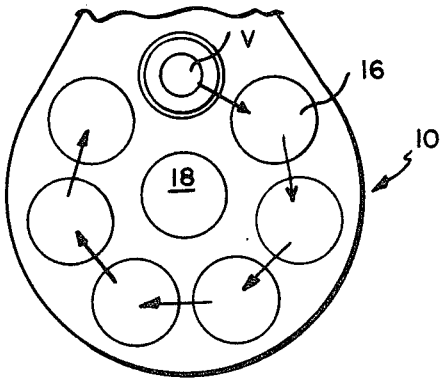

FIG. 5 diagrammatically illustrates the method for keeping track of the daily dosages of insulin when one dosage is required per day; and FIG. 6 diagrammatically illustrates the method for keeping track of the daily dosages of insulin where two dosages are required per day.

Figure 1:
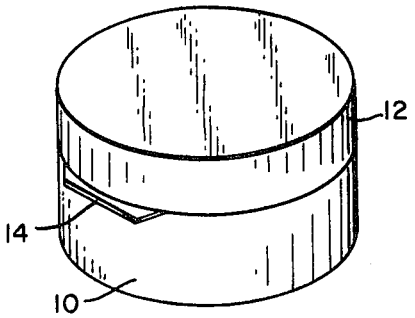
FIG. 1 is a perspective of the container of this invention.

Referring to the drawings, FIG. 1 is a perspective view of the receptacle embodying the structure of the present invention comprising a bottom part 10 which constitutes a receptacle and a top part 12 which constitutes a cover. The structure is of circular horizontal section as more plainly shown in FIG. 2 and the cover 12 is connected to the receptacle 10 by a hinge member 14 which allows the cover to be folded down over the open top of the receptacle or to be folded back from the open top of the receptacle.

The receptacle 10 is divided into a plurality of circularly-arranged pockets 16 centered about the geometric center of the receptacle and a centrally-located pocket 18 at the geometric center of the receptacle. The circularly-arranged pockets 16 are connected at their outer sides in substantially tangential relation to the peripheral wall of the receptacle by webs 20 to each other at their places of tangency by webs 22 and to the centrally-located pocket by radial ribs 24. The pockets are open at their upper ends and closed at their lower ends by a bottom wall 26.

Figure 3:
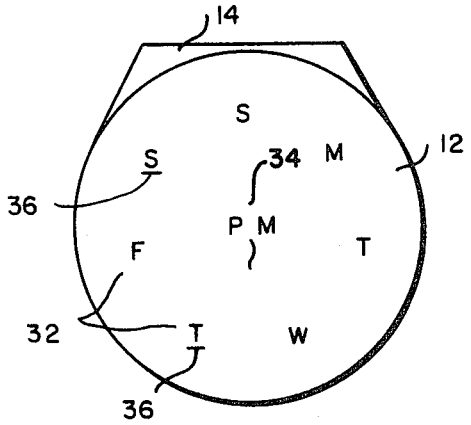
FIG. 3 is a plan view of the cover.
Figure 4:
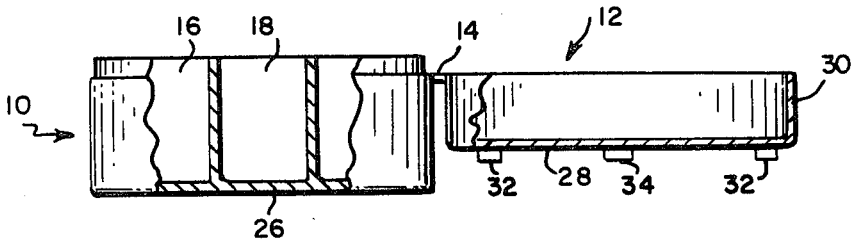
FIG. 4 is an elevation partly in section with the cover in an open position.

The cover 12 comprises a top wall 28 and a circular side wall 30. The hinge 14 connecting the cover to the receptacle comprises a web integral at one end with the upper edge of the receptacle and at its other end with the lower edge of the cover. Desirably, the cover as shown in FIG. 3 is provided on the top wall with raised indicia 32 representing the days of the week arranged peripherally thereof above the circularly-arranged pockets and a raised indicia 34 at the center representing the centrally-located pocket. Desirably, the indicia 32 comprise the letters S, M, T, W, T, F, S corresponding to Sunday, Monday, Tuesday, Wednesday, Thursday, Friday and Saturday and since the days Sunday and Saturday and Tuesday and Thursday are represented by the same letters, in order to prevent any possible confusion, the second S and the second T in the order of arrangement clockwise is distinguished from the first by an embossment 36 placed below the letter.

Figure 2:
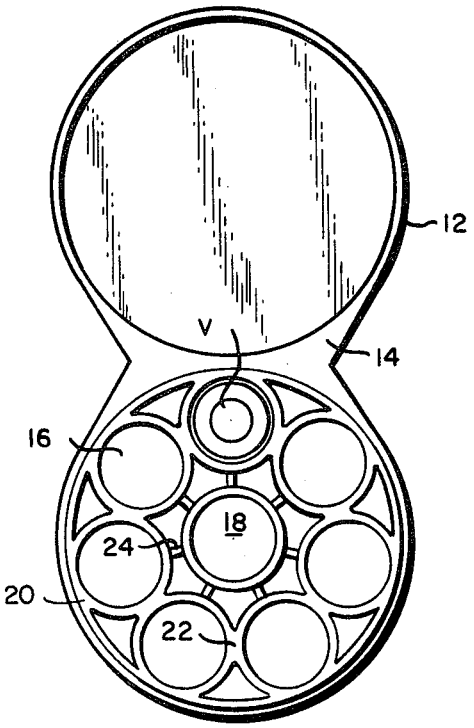
FIG. 2 is a plan view of the container with the cover folded back to an open position.

As previously remarked, insulin is provided in a vial in a quantity such as to represent a number of dosages, for example, enough insulin for two dosages a day for every day in the week. When the required dosage is one per day, the device is used to ensure taking but one dosage a day by placing the vial V in the pocket 16 representing the first day the dosage is to commence. Assuming the first day is Sunday, the vial is placed in the pocket located at the 12:00 o'clock position as seen in FIG. 2. On Sunday, the diabetic opens the cover and finding the vial in the pocket at the 12:00 o'clock position which he knows is Sunday by reason of its position, removes the vial from the pocket, removes the dosage from the vial, administers it, and then replaces the vial in the next pocket in a clockwise direction which he knows is the Monday pocket from which he will take the vial the next day when the dosage is due. Thus, should the diabetic later on in the day not remember whether or not he has taken his dosage, he can return to the receptacle and, by sight or feel, see that he has positively taken the Sunday dosage since the vial is now in the Monday pocket and thus he knows that he is not to take another dosage until the next day. By continuing this practice, the diabetic will be assured of taking a dosage each day and will be sure that he does not take more than one dosage each day.

If two dosages per day are prescribed, the device is used as follows: Starting with the vial in the Sunday pocket, FIG. 6, he removes the vial from the Sunday pocket at the prescribed A.M. time, removes the dosage from the vial and then places the vial in the centrally-located pocket. Now, when the time comes for taking the second dosage in the P.M., he finds that, because the vial is in the centrally-located pocket, he has already taken the A.M. dosage and now he must take the P.M. dosage. After taking the second dosage, he places the vial in the Monday pocket. Thus, he is assured, if he cannot remember, that he has taken both dosages and is not to take another dosage until the next day. Continuing this procedure, the diabetic continues clockwise around the receptacle, removing the vial from a circularly-arranged pocket to a centrally-located pocket and back to the next circularly-arranged pocket in the succession of pockets clockwise throughout the week as indicated by the arrows, FIG. 6.

Thus, with the aid of the device described, a diabetic can be sure, whether he takes a single dose or two doses a day, that he has neither forgotten to take a dose nor taken more doses than he should.

The structure is desirably molded from a suitable plastic which may be transparent and of sufficient toughness and elasticity so that it can be refrigerated and repeatedly used by a diabetic to control his use of insulin. Once he has purchased the dispenser, it is only necessary to replenish it from time-to-time with a vial of insulin to enable him to carry out the necessary controlled use of the insulin for himself or for someone else.

It should be understood that the present disclosure is for the purpose of illustration only and includes all modifications or improvements which fall within the scope of the appended claims.

What is claimed is:

1. A receptacle for insulin dosing comprising a bottom part of circular cross section closed at the bottom and open at the top, a top part of corresponding circular cross section closed at the top and open at the bottom, a hinge connecting the top part to the bottom part, and a lip positioned circumferentially of the open top of the bottom part dimensioned to be received within the open bottom of the top part, means defining a series of seven pockets of circular cross section position circularly about the center of the bottom part and a center pocket positioned within the circle of the seven pockets, said pockets being dimensioned to removably receive a vial of insulin such as to enable moving the vial of insulin from one pocket to another, said pockets being so arranged that the center of one of the circularly-arranged pockets is located on a diameter perpendicular to the hinge line connecting the cover to the bottom and the remaining six pockets, not including the center pocket, are arranged symmetrically about the center pocket at uniform spacing peripherally of the container such that if said one pocket represents Sunday, the remaining pockets clockwise of the center pocket represent the days of the week and wherein the center pocket provides, in conjunction with any one of the circularly-arranged pockets, for, on a given day, receiving an A.M. dosage and a P.M. dosage and raised indicia on the cover representing the days of the week arranged in the position thereon of the underlined pockets.

2. A method of administering daily dosages of insulin from a single vial of insulin containing a quantity of insulin representing a plurality of dosages comprising providing a receptacle with circularly-arranged pockets corresponding in number to the days of the week, placing a single vial of insulin representing a plurality of dosages in one of the circularly-arranged pockets represented by its position in the circular arrangement a specific day of the week, removing the vial from the said pocket, removing a dosage from the vial and, after administering the dosage, transferring the vial to the circularly-arranged pocket representing the day when the next dosage is to be taken and repeating the procedure throughout the week.

3. The method according to claim 2 wherein the vial is transferred from one circularly-arranged pocket to the next in succession after each dosage is administered.

4. The method of administering daily dosages of insulin from a single vial containing a quantity of insulin representing a plurality of doses comprising providing a receptacle with circularly-arranged pockets corresponding in number to the days of the week and a centrally-located pocket with a vial in one of the circularly-located pockets represented by its position in the circular arrangement a specific day of the week, removing the vial from said pocket, removing a dosage from the vial, replacing the vial in the centrally-located pocket, removing the vial from the centrally-located pocket for a second dose on the same day, replacing the vial in the circularly-arranged pocket next succeeding the circularly-arranged pocket from which it was initially removed and repeating the procedure throughout the remainder of the week or for so long as the insulin remains in the vial.

* * * * *